United States Patent [19]

Tse et al.

[11] Patent Number: 4,925,528

[45] **Date of Patent: * May 15, 1990**

[54] MANUFACTURE OF WETLAID NONWOVEN WEBS

[75] Inventors: Stephen H. Tse, Midlothian, Va.; David H. Hollenberg, Neenah, Wis.; Richard L. Martin, Menasha, Wis.; James H. Manning, Appleton, Wis.

[73] Assignee: James River Corporation of Virginia, Richmond, Va.

[ * ] Notice: The portion of the term of this patent subsequent to Apr. 18, 2006 has been disclaimed.

[21] Appl. No.: 334,604

[22] Filed: Apr. 6, 1989

Related U.S. Application Data

[63] Continuation-in-part of Ser. No. 219,909, Jul. 18, 1988, Pat. No. 4,822,452, which is a continuation-in-part of Ser. No. 35,059, Apr. 6, 1987, abandoned.

[51] Int. Cl.[5] ..... D21H 5/12

[52] U.S. Cl. ..... 162/146; 162/157.2; 162/157.6; 162/157.7; 162/164.6; 162/168.1; 162/168.2; 162/177; 162/202

[58] Field of Search ..... 162/157.2, 164.6, 146, 162/168.1, 168.2, 177, 183, 182, 202, 157.6, 157.7

[56] References Cited

U.S. PATENT DOCUMENTS

| | | | |
|---|---|---|---|
| 4,179,543 | 12/1979 | Hawkins | 162/157.3 |
| 4,294,883 | 10/1981 | Hawkins | 162/157.3 |
| 4,655,877 | 4/1987 | Horimoto et al. | 162/157.2 |

*Primary Examiner*—Peter Chin

*Attorney, Agent, or Firm*—William A. Aguele; Richard J. Gallagher; Thomas H. Whaley

[57] ABSTRACT

A method for forming a fabric web by wet-laying fibers on paper-making equipment, the web comprising staple length natural or synthetic fibers and optionally wood cellulose papermaking fibers and an adsorbed polymeric surface active agent. The method comprises making up an aqueous fiber furnish with a polymeric surfactant having a plurality of both hydrophilic and hydrophobic groupings per molecule. The polymeric surfactant is adsorbed by the fibers and may be added to the fibers or it may be included in the aqueous carrier medium. In either case, the finished web contains and is improved by the inclusion of the polymeric surfactant.

12 Claims, No Drawings

MANUFACTURE OF WETLAID NONWOVEN WEBS

This application is a continuation-in-part of copending U.S. patent application Ser. No. 219,909, filed July 18, 1988, now U.S. Pat. No. 4,822,452 which, in turn is a continuation-in-part of copending U.S. patent application, Ser. No. 35,059, filed Apr. 6, 1987, and now abandoned.

This invention relates to an improved method for the manufacture of a uniform fibrous web comprising textile length fibers by wet forming the web on a conventional papermaking machine. In one of its more specific aspects, this invention relates to a method for forming a uniform web from an unfoamed dispersion of staple length natural or synthetic fibers in water containing a small amount of a polymeric surfactant, a number of which are known as associative thickeners. In one of its still more specific aspects, this invention relates to the use of a polymeric surfactant of the type known as an associative thickener consisting essentially of an ethylene oxide based urethane block copolymer having alternating blocks of polyethylene glycol and polyurethane as dispersant in water as the carrier for natural and synthetic fibers. In still another of its more specific aspects, this invention relates to the use of another polymeric surfactant known as an associative thickener consisting essentially of a hydroxyethylcellulose having a long aliphatic side chain as the dispersant and thickener for natural and synthetic cellulosic fibers in a water carrier.

As used throughout this specification, the term polymeric surfactant is defined as a molecule which contains a plurality (two or more) of both hydrophilic moieties and hydrophobic moieties. This definition derives from that of a simple surfactant (surface active agent) comprising a hydrophilic moiety and a hydrophobic moiety. The difference in the hydrophilic and hydrophobic portions of the polymeric surfactant molecules control the propensity of these molecules to arrange themselves in preferential molecular orientations at the interface between dissimilar substances. In the case of the present invention, the polymer surfactants attach themselves to the surfaces of fibers at their interface with water as the suspending medium.

The key molecular feature is that the molecules contain both hydrophilic portions and hydrophobic portions. The key distinction from simple surfactants is that these molecules would contain a multiplicity (two or more) of these types of groups. The type of groups, as well as the relative positions of these groups within specific molecules, can include a broad range of chemical moieties and distributions.

The associative thickener molecules have a multiplicity of hydrophobic and hydrophilic portions or "blocks" which form networks in an aqueous carrier medium, the exact nature of which is dependent upon the molecular shape and composition, as well as the nature of the solvent. The formation of networks provides changes in the rheology of the solution that result in increases in viscosity; hence, the term "associative thickeners." Associative thickeners have been used in the paint industry for changing the rheological properties of paint formulations.

Methods for forming non-woven fibrous webs containing textile length fibers, e.g. synthetic fibers having a length to-diameter ratio in the range of from about 300 to about 3000, in a wet paper-making process are known in the art. Generally, a viscous aqueous carrier comprising a dispersant and thickener is required for good dispersion of long thin flexible synthetic fibers, e.g. 1.5 denier by ¾ inch fibers. The long thin synthetic fibers tend to tangle and form flocs or knits in the finished non-woven fabric when formed from an aqueous dispersion suitable for wet laying paper-making fibers on a paper-making machine.

Foam furnishes have been proposed as a viscous aqueous carrier medium to ensure good dispersion of the long fibers, for example, as disclosed in U.S. Pat. No. 4,049,491. While aqueous foams have been shown to be suitable carriers for staple length fibers, the high viscosity of foam results in relatively slow drainage of water from the wire of the paper-making machine. Other methods proposed for this purpose include the addition of thickeners to an unfoamed water carrier, for example, as disclosed in U.S. Pat. No. 3,098,786 wherein deacetylated karaya gum and sulfuric acid are included in the water-fiber furnish, and in U.S. Pat. No. 3,013,936 in which a synthetic fiber is modified to include available hydrophilic groups and the thickener is a water-swellable, water insoluble gum. Various water soluble polymers are disclosed as dispersing aids for staple length fibers in U.S. Pat. Nos. 3,808,095 and 3,794,557 including anionic, cationic and nonionic dispersing agents, among which is polyethyleneoxide.

We have now discovered an improved method for forming fibrous webs from a water furnish containing textile length fibers which comprises the inclusion of a polymeric surfactant associative thickener in the water making up the fiber furnish. Such polymer surfactant associative thickeners have been developed primarily for use in the formulation of latex paints. The urethane block copolymers are described by E. J. Schaller and P. J. Rogers-Moses, Resin Review, Vol. XXXVI, No. 2, pp 19–26, incorporated herein by reference. The hydrophobically-modified hydroxyethylcellulose associative thickeners are described by K. G. Shaw and D. P. Liepold, Journal of Coatings Technology 57, No. 727, pp 63–72 (August, 1985), incorporated herein by reference. In latex paints, such associative thickeners are used to give the formulation certain desirable properties, e.g., enough viscosity to resist running and over-spreading; spatter resistance; and improved leveling properties. The use of these associative thickeners in the manufacture of a water laid fabric web is disclosed in our copending patent application, Ser. No. 219,909 now U.S. Pat. No. 4,822,452.

In the process of this invention, a dispersion of fibers in water is made up with a small amount of an associative thickener which acts as both a surfactant (or dispersant) and as a thickener, slightly increasing the viscosity of the water carrier medium and acting as a lubricant for the fibers. One class of polymeric surfactant associative thickeners preferred in the process of this invention comprises relatively low (10,000 to 200,000) molecular weight ethylene oxide based urethane block copolymers and is disclosed in U.S. Pat. Nos. 4,079,028 and 4,155,892, incorporated herein by reference. These associative thickeners are particularly effective when the fiber furnish contains 10 percent or more staple length hydrophobic fibers. Commercial formulations of these copolymers are sold by Rohm and Haas, Philadelphia, PA, under the trade names Acrysol RM-825 and Acrysol Rheology Modifiers QR-708, QR-735 and QR-1001 which comprise the urethane block copolymers in different carrier fluids. Acrysol RM-825 is a 25 percent solids grade of polymer in a mixture of 25 percent butyl carbitol (a diethylene glycol monobutyl ether) and 75 percent water. Acrysol Rheology Modifier QR-708, a 35 percent solids grade in a mixture of 60 percent propylene glycol and 40 percent water, has been found to produce excellent results in test runs as reported in Examples 1 and 2, below. Similar copolymers in this class including those marketed by Union Carbide Corporation, Danbury, CT, under the trade names SCT-200 and SCT-275 are useful in the process of this invention. These are polyurethane oxide/urethane/hydrophobe copolymers. Another associative thickener is marketed by Hi-Tek Polymers, Jeffersontown, KY, and has been described as a hydrophobically modified polyethylene oxide.

Another class of associative thickeners, preferred for making up fiber furnishes containing predominantly cellulosic fibers, e.g., rayon fibers or a blend of wood fibers and synthetic cellulosic fibers, such as rayon, comprises modified cellulose ethers of the type disclosed in U.S. Pat. No. 4,228,277, incorporated herein by reference, and sold under the trade name Aqualon by Hercules Incorporated, Wilmington, Delaware. Aqualon WSP M-1017, a hydroxyethyl cellulose modified with a $C_{10}$ to $C_{24}$ side chain alkyl group and having a molecular weight in the range of 50,000 to 400,000 was found to be particularly effective for the preparation of fiber furnishes comprising rayon fibers, as illustrated in Example 3.

We have found that the polymeric surfactants having a plurality of both hydrophilic and hydrophobic groups per molecule are effective as a thickener and dispersant for the preparation of fiber furnishes containing textile length fibers. The urethane block copolymers described hereinabove are effective for furnishes containing hydrophobic fibers, for example, polyester, acrylic, polyamide, polyolefin, and modified acrylic fibers in a water carrier. The urethane block copolymers are of especial importance in the preparation of unfoamed fiber in water furnishes containing textile length hydrophobic fibers alone or in admixture with cellulosic paper-making fibers. The modified cellulose ethers described hereinabove are particularly useful in the preparation of fiber furnishes in which the textile length fibers are cellulosic fibers, e.g. rayon fibers, alone or in admixture with natural wood fibers and similar cellulosic fibers suitable for use in making paper. Although conventional papermaking fibers are preferred in such mixtures, high bulking fibers which have been subjected to chemical or mechanical treatment, e.g. caustic treatment or high energy wet or dry milling, to kink and curl the fibers may be included in the furnish.

Without wishing to limit the scope of this invention, the following observations are offered relative to the efficacy of the polymeric surfactants as dispersants and binding agents. We have now discovered that the polymeric surfactants bind themselves to the surface of the fibers and also that they act as binding agents in the finished web.

Fibers were dispersed in an aqueous solution of polymeric surfactant and, after allowing time for complete wetting of the fibers, excess solution was removed by filtration. The fibers were then resuspended in water containing no polymeric surfactant. The dispersion of the fibers was equivalent to dispersion of the fiber in the original solution containing the polymeric surfactant. Additional evidence of adsorption of polymeric surfactant onto the fiber was obtained from the physical materials. The strength of sheets increased in substrates made with the dispersants relative to sheets made without treatment of fibers with these chemicals. Sheets containing polyester fibers, as well as sheets containing only wood fibers showed increases in tensile strength and tear strength properties when they contained adsorbed polymeric surfactant. Some surface modification of the fibers occurred as a result of the treatment giving evidence not only of the adsorption of the polymeric surfactant onto the surfaces of the fibers, but also of a preferential orientation of the polymer on the surface of the fiber that results in changes in the bonding capabilities. The adsorption of the polymer onto the polyester arises through Van der Waal's forces between the hydrophobic portions of the polymer and the surface of the polyester. These Van der Waal's forces are the same as the Van der Waal's forces that influence the associative nature of the molecule and are akin to the forces that govern micelle formation in normal surfactants. Because of the multiplicity of hydrophobic sections within the polymer, adsorption of a molecule of the polymeric surfactant is favored, i.e., the probability of any specific hydrophobic section to be absorbed may be low, but there are many hydrophobes per molecule, and therefore at any given instant, one or more hydrophobes in a molecule have a higher possibility of adsorption. As a result of the adsorption of the hydrophobic portions of the polymeric surfactant onto the fiber, the hydrophilic portions are oriented so that they interact with the water. This permits wetting of the surface of the fiber and inhibits the forces that promote flocculation.

Another illustration involves the dispersion of wood fiber with the same polymeric surfactant. In this instance the wood fiber surface is hydrophilic. In order to induce dispersion, a simple surfactant that is substantive to the wood fiber surface is added to the wood fiber prior to addition of the polymeric surfactant. Quaternary ammonium surfactants have generally been found to adsorb onto wood fibers. This generally is regarded as occurring through ionic interactions of the negatively charged wood fiber surface with the positively charged quaternary ammonium group of the simple surfactant. This orients the hydrophobic portion of the surfactant so that it may interact with the hydrophobic portions of the polymeric surfactant. Improved dispersion and changes in bonding properties of the fibers result from the interactions of the fiber surface with the polymeric surfactant as mediated through the quaternary ammonium surfactant.

Further evidence of the importance of adsorption as a necessary condition for dispersion derives from measurements of viscosity of the bulk phase of fiber/polymeric surfactant suspensions. The prior art relating to dispersion of long fibers and synthetic fibers in papermaking and wet-laid nonwoven manufacture depends almost exclusively on increasing the viscosity of the bulk phase.

The increased viscosity of these systems reduces the flocculation tendencies of the fibers. In the present instance, measurement of the viscosity of the bulk phase of the suspending medium indicates that the change in viscosity of the system cannot account for the improved dispersion of the fibers. Although small increases in viscosity have been observed, they are on the order of one to two centipoises. This slight increase in viscosity is not commensurate with the expected viscosity of the polymeric surfactant if it was primarily in the bulk phase and therefore could not account for the improved dispersion.

Since the polymeric surfactants become part of the final product, they may be used to produce substrates with properties different from substrates produced without this technology. Appropriate choice of the polymeric surfactant can result in changes in fiber bonding characteristics, absorbency and wettability properties, surface free energy and the related abilities to adsorb other chemicals, particles, colorants, dyes, coatings or emulsions either onto the fibers or onto the formed substrate.

The hydrophobic fibers forming the aqueous dispersion and the ultimate fabric may comprise from about 10 to about 100 percent by weight of staple length fibers and from 0 to 90 percent conventional wood fibers. Synthetic fibers in the size range of 1 to 4 denier by ¾ to 1.5 inch are preferred. Suitable textile fibers include polyester fibers, e.g. those sold under the trade names Trevira, Dacron, Kodel, Fortrel, etc.; acrylic fibers, e.g. those sold under the trade names Creslan, Acrilan, Orlon, etc.; polyamide fibers, e.g. nylons, polyolefin fibers, e.g. polypropylene; and modified acrylic fibers including those sold under the trade name Dynel. Inorganic fibers, including glass fibers may comprise part or all of the textile length fibers. Any of the wood cellulose fibers may be used with either type nonionic associative thickener; those comprising or consisting essentially of soft wood fibers are preferred. Other fibers may be used in conjunction with or instead of wood cellulose fibers. In addition to rayon, other known cellulosic fibers, e.g. cotton linters, may be used in the process. The modified nonionic hydroxyethyl cellulose associative thickeners are, however, relatively ineffective for dispersion of hydrophobic fibers.

For best results, the wood cellulose pulp is dispersed in water prior to adding the associative thickener, followed by the addition of the associative thickener in an amount in the range of from 1 to 150 pounds per ton of dry fiber making up the furnish and then the addition and dispersion of the staple length fibers. Finally, the dispersion of mixed fibers in an unfoamed water carrier is diluted to the desired headbox consistency and dispensed onto the forming wire of a conventional papermaking machine. An anti-foam agent may be added to the dispersion to prevent foaming, if necessary, and a wetting agent may be employed to assist in wetting the staple length fibers if desired.

The fibers preferably are made up into an aqueous dispersion suitable for wet forming on a moving wire former in the following manner. The wood pulp is first dispersed in water or in recycled white water to a consistency of about 1 to 2 percent. Then an associative thickener is added to the resulting slurry in an amount within the range of about 10 to 500 ppm, preferably in the range of 25 to 120 ppm, followed by the addition of the textile length fibers with continuous mixing under low shear conditions. After the fibers are thoroughly blended,the slurry is further diluted with fresh water and white water to the final headbox furnish consistency, preferably to a consistency in the range of 0.01 to 0.5 percent with a nascent viscosity in the range of 1.21 to 2.54 centipoises and supplied to the headbox of a papermaking machine. A non-woven fabric web may be formed from a staple length textile fiber furnish on high speed conventional Fourdrinier papermaking machines to produce a strong, uniform product of excellent formation.

In making up the fiber dispersion containing the staple length fibers, low shear agitation, as provided by a non-stapling agitator is preferred to avoid tangling of the long fibers. As illustrated in Example 2, a small amount of a conventional polymer thickener may be added to the dispersion to more precisely control drainage of water from the wire during web formation. While a number of nonionic polymers may be used for this purpose, the anionic polymer sold under the trade name Hydraid 7300-C by Calgon, Inc., Pittsburgh, Pa. is particularly effective at concentrations of the order of 100 ppm. A defoamer, e.g. the product sold under the trade name DF-122 by Diamond Shamrock Company may be added, if required, during the preparation of the fiber furnish to eliminate foam formation in the dispersion.

A number of advantages result from dispersion of staple length fibers in a water solution of an associative thickener as compared with dispersions in foam or water containing surfactants and conventional polymer thickeners. The lower nascent viscosity of the aqueous carrier composition of this invention, as compared with prior art processes employing conventional thickeners and surfactants, results in higher drainage rates through the forming wire and permits formation on conventional Fourdrinier machines at high wire speeds. In contrast to prior art processes, special machines with sloping wires and conforming headboxes are not required for operation of our process. The dispersion is neither excessively thickened nor foamed, making it possible to handle the dispersion with conventional centrifugal pumps and to use conventional headboxes and forming wires, and to operate such equipment at high wire speeds. Good dispersion of the fibers is obtained without the need for high energy pulping equipment. Additionally, the total chemical usage is lower in the process of this invention than for processes currently used for forming non-woven fabric webs from staple length fibers.

The following examples further describe and illustrate the process of this invention.

EXAMPLE 1

A batch fiber-water dispersion was made up with 6000 pounds of water in a mix tank equipped with a nonstapling agitator by adding in the following order: (a) 46 pounds of West Coast bleached softwood slush pulp at 36% solids; (b) 1.6 pounds of nonionic associative thickener, Acrysol QR-708, 34% active (Rohm and Haas Philadelphia, PA); and (c) 16.5 pounds of polyester staple, 1.5 denier×¾-inch (Hoechst Trevira Type 101 SD OW). The mixture was agitated for 20 minutes and then pumped with a centrifugal pump to the exit side of a fan pump where it was diluted to 0.8% consistency with white water at 100° F. containing 82 ppm Acrysol QR-708 and 3 ppm Foammaster Defoamer DF-122 (a product of Diamond Shamrock). The nascent viscosity of the water in the mix chest and of the white water was 1.2 centipoises. The dispersion was formed on an inclined wire former producing a non-woven web with good formation. Physical properties of the product web are shown in Table II below.

EXAMPLE 2

A trial run was made with a furnish of 60 weight percent of Marathon Northern Softwood blended kraft pulp and 40 weight percent 1.5 denier × ¾-inch polyester fibers. A 4000 gallon capacity hi-lo pulper was used to break up dried sheets of the bleached kraft pulp. Three thousand gallons of fresh water heated to 88° F. was added first, then 300 pounds of the pulp was added. The pulp was dispersed by using both high and low agitators for 25 minutes. Then 20 pounds of Acrysol QR-708 (34% active) was dissolved in five gallons of water at 160° F. and added to the pulper followed by the addition of 140 gallons of Calgon's Hydraid 7300-C made to 0.58 volume percent solution in water at 70° F.

Then 200 pounds of Hoechst Trevira polyester (1.5 denier × ¾-inch) was added while only the lower agitator mixed the stock. Since some foam appeared, one pint of Diamond Shamrock's Defoamer DF-122 was added and the entire mix pulped for 20 minutes. It was then pumped with a centrifugal pump to a mix chest where it was diluted with another 4000 gallons of fresh water at 88° F. The mix from the mix chest was then pumped with a centrifugal pump to the machine chest without further dilution. The dispersion from the machine chest was pumped to the headbox of a wire former with a centrifugal pump where it was diluted to 0.065% consistency with white water which contained 100 ppm Acrysol QR-708 and 100 ppm Hydraid 7300-C. Table I lists the viscosity data obtained during the trial using the UL attachment to a Brookfield viscometer and Table II, below, lists the physical properties of the product web.

TABLE I

Nascent Viscosity of Water Carrier

| Location and Description | Viscometer Temp. °F. | Viscosity cp |
|---|---|---|
| Pulper - water only | 62 | 1.20 |
| Pulper - QR-708 200 ppm | 63 | 1.21 |
| Pulper QR-708 (200 ppm) and 7300-C (200 ppm) | 62 | 2.54 |
| Machine chest QR-708 (100 ppm) 7300-C (100 ppm) | 62 | 1.49 |
| Headbox QR-708 (100 ppm) 7300-C (100 ppm) | 63 | 1.38(1) |

(1) The headbox viscosity was lower than the machine chest viscosity because of dilution of the stock to the headbox with plain water.

EXAMPLE 3

Approximately fifty 30 lb/rm handsheets consisting of 70% 1.5 denier × ½-inch rayon fibers and 30% Ontario soft wood kraft pulp were made on an M/K Systems, Inc. Series 8000 Computerized Sheet Former consisting of three main components: the Sheet Former itself with its Forming and Pressing/Drying sections, a 200-liter stock tank, and a Hewlett Packard HP-85 desk top computer which controls the operation of the Sheet Former.

In a valley beater, 269 grams of wet wood pump of about 40% consistency was mixed with 23 liters of cold tap water for then minutes and removed to the stock tank of the Sheet Former where it was added to approximately 80 liters of cold tap water. The wood pulp stock was added to the water and air agitation from a ring at the bottom of the tank was begun. To this was added 1160 grams of a 1% by weight solution of Aqualon WSP M-1017 (90 parts per million for the 180 liter total volume of the stock). When foaming was observed in the stock tank, 1.5 ml. of Foam Master 122 (defoamer) was added and the foaming subsided.

In the same valley beater containing approximately 10 liters of cold tap water, 460 grams of the 1% solution of Aqualon were added (200 parts per million for 23 liters), mixing was begun and foam developed. Ten drops of Foam Master 122 were added and the foam disappeared. Then 245 grams of the rayon were added slowly. Cold tap water was also added to make up 23 liters of water. This mixture was beat for fifteen minutes and then removed to the stock tank of the Sheet Former.

After the rayon stock from the beater was added to the stock tank, cold tap water was added to make up the total volume of water to 180 liters. The temperature of the mixture in the stock tank was 14° C. or 57° F.

On the Sheet Former program, fresh water addition was 10 seconds; white water addition 7 seconds; stock addition 8 seconds; agitation time, 30 seconds; and settling time was 5 seconds. The average drainage time for each sheet was 10.1 seconds.

In the Pressing/Drying section, the press pressure was set at 20 psi and the felt tension was set at 20 psi.

The physical properties of the handsheet are summarized in Table II.

TABLE II

Physical Properties of Nonwoven Sheets

| | Example 1 | Example 2 | Example 3 |
|---|---|---|---|
| Basis Wt. lb/3000 ft | 33.4 | 39.9 | 32.1 |
| Caliper, mils 3 ply | 58.8 | 44 | 32.8 |
| Dry Strip Tensile, MD | 1224 | 3430 | 2034 |
| g/3-inch CD | 887 | 2380 | NA |
| Elmendorf, tear grams MD | 54.2 | NA | 57 |
| CD | 78.8 | NA | NA |
| Frazer Frazer air Permeability, $ft^3/min/ft^2$ 0.5 inch water P | 199.2 | 84.3 | 105.9 |

We claim:

1. In a method for the production of a fibrous web from natural synthetic fibers which comprises forming a fiber furnish by dispersing the fibers in water and supplying the fiber furnish to the wire of a papermaking machine forming a fibrous web, the improvement which comprises dispersing the fibers in an aqueous carrier in the presence of a polymeric surfactant associative thickener containing two or more of both hydrophobic and hydrophilic groupings per molecule and having a molecular weight in the range of from about 10,000 to about 400,000 in an amount within the range of from about 1 to about 150 pounds polymeric surfactant per pound of dry fiber.

2. The method according to claim 1 wherein the fibers consist essentially of wood cellulose papermaking fibers.

3. The method according to claim 1 wherein the fibers consist essentially of hydrophobic synthetic fibers and the polymeric surfactant consists essentially of ethylene oxide based urethane block copolymers having a molecular weight in the range of from about 10,000 to about 200,000.

4. The method according to claim 1 wherein the fibers consist essentially of hydrophilic fibers and the aqueous carrier contains a hydrophilic wetting agent.

5. The method according to claim 1 wherein the fibers are a mixture of wood cellulose papermaking fibers and textile length fibers.

6. The method according to claim 5 wherein the textile length fibers are reconstituted cellulose and the polymeric surfactant associative thickener consists essentially of hydroxyethyl cellulose having a $C_{10}$ to $C_{24}$ side chain and a molecular weight in the range of from about 50,000 to about 400,000.

7. The method according to claim 5 wherein the textile length fibers are synthetic fibers.

8. In a process for manufacture of a wet laid fibrous web from a dispersion of papermaking fibers in an aqueous carrier medium, the improvement which comprises forming a fiber in water furnish containing from 1 to 150 pounds per ton of dry fiber of polymeric surfactant ethylene oxide based urethane block copolymers having a molecular weight in the range of from about 10,000 to about 200,000 and hydroxyethyl cellulose ethers having a $C_{10}$ to $C_{24}$ alkyl side chain and a molecular weight in the range of from about 50,000 to about 400,000 and forming the wet laid web from the resulting unfoamed fiber furnish.

9. A composition of matter consisting essentially of dry paper or papermaking fibers having associated therewith from about 1 to 150 pounds per ton of dry fiber of polymeric surfactant associative thickener containing two or more of both hydrophilic and hydrophobic groupings per molecule with a molecular weight in the range of from about 10,000 to about 400,000.

10. In a process for the manufacture of a wet laid fibrous web from a fiber furnish comprising a dispersion of papermaking fibers in a an aqueous carrier medium, the improvement which comprises incorporating a polymeric surfactant associative thickener containing two or more of both hydrophobic and hydrophilic groupings per molecule and having a molecular weight in the range of from about 10,000 to about 400,000 into the fibers and thereafter dispersing the papermaking fibers containing from about 1 to about 150 pounds of polymeric surfactant per ton of dry fibers in an aqueous carrier forming the fiber furnish.

11. A method according to claim 5 wherein the wood cellulose fibers are contacted with a quaternary ammonium surfactant prior to dispersion in an aqueous carrier containing the polymeric surfactant associative thickener.

12. A method according to claim 11 wherein the textile length fibers are hydrophobic synthetic fibers and the polymeric surfactant associative thickener is an ethylene oxide based urethane block copolymer having a molecular weight in the range of from about 10,000 to 200,000.

* * * * *

UNITED STATES PATENT AND TRADEMARK OFFICE

CERTIFICATE OF CORRECTION

PATENT NO. : 4,925,528

DATED : May 15, 1990

INVENTOR(S) : Stephen H. Tse, et al

It is certified that error appears in the above-identified patent and that said Letters Patent is hereby corrected as shown below:

Column 8, line 40:

Claim 1, line 2, "natural synthetic" should be --natural or synthetic--.

Signed and Sealed this

Twenty-third Day of July, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,925,528

DATED : May 15, 1990

INVENTOR(S) : Stephen H. Tse, et al

It is certified that error appears in the above-identified patent and that said Letters Patent is hereby corrected as shown below:

Claim 1, line 2, "natural synthetic" should be --natural or synthetic--.

Claim 1, line 13, "pound" should be --ton--.

This certificate supersedes Certificate of Correction issued July 23, 1991.

Signed and Sealed this

Twelfth Day of November, 1991

*Attest:*

HARRY F. MANBECK, JR.

*Attesting Officer*

*Commissioner of Patents and Trademarks*